US006932313B1

(12) United States Patent
Akrep

(10) Patent No.: US 6,932,313 B1
(45) Date of Patent: Aug. 23, 2005

(54) ROTARY SPREADER BEAM II

(76) Inventor: Michael J. Akrep, 217 Russell St., Hadley, MA (US) 01035

( * ) Notice: Subject to any disclaimer, the term of this patent is extended or adjusted under 35 U.S.C. 154(b) by 136 days.

(21) Appl. No.: 10/425,240

(22) Filed: Apr. 30, 2003

Related U.S. Application Data

(60) Provisional application No. 60/375,386, filed on Apr. 26, 2002.

(51) Int. Cl.[7] ..... A47H 1/10

(52) U.S. Cl. ..... 248/324

(58) Field of Search ..... 248/323, 317, 248/324, 327, 489, 495, 496, 343; 294/81.2, 81.3, 81.21, 81.4, 81.5, 81.56, 67.21, 67.5; 52/39, 731.7, 125.2, 125.6, 122.1; 403/52, 43, 112, 113, 119, 408.1

(56) References Cited

U.S. PATENT DOCUMENTS

| | | | | | |
|---|---|---|---|---|---|
| 2,020,174 | A | * | 11/1935 | Derossi | 294/81.55 |
| 2,703,252 | A | | 3/1955 | Blackwell | 294/78 |
| 2,721,757 | A | * | 10/1955 | Anderson | 294/81.2 |
| 3,119,499 | A | | 1/1964 | Tallquist | |
| 3,437,369 | A | * | 4/1969 | Gealy | 294/67.32 |
| 3,536,281 | A | * | 10/1970 | Attore et al. | 248/73 |
| 3,549,190 | A | | 12/1970 | Caldwell | |
| 4,114,765 | A | * | 9/1978 | Kojima | 414/756 |
| 4,289,090 | A | | 9/1981 | Bagby et al. | 118/630 |
| 4,355,832 | A | | 10/1982 | Andersen | 294/81 R |
| 4,685,714 | A | | 8/1987 | Hoke | 294/81.2 |
| 4,826,228 | A | * | 5/1989 | Dinitz et al. | 294/81.56 |
| 6,042,165 | A | * | 3/2000 | Thompson | 294/67.32 |
| 6,102,351 | A | | 8/2000 | Akrep | |

FOREIGN PATENT DOCUMENTS

| | | |
|---|---|---|
| DE | 249688 | 9/1987 |

* cited by examiner

*Primary Examiner*—Leslie A. Braun
*Assistant Examiner*—A. Joseph Wujciak
(74) *Attorney, Agent, or Firm*—Deborah A. Basile

(57) ABSTRACT

Disclosed herein is a structural element comprising a longitudinal vertical component and a longitudinal horizontal component extending from and parallel to the longitudinal vertical component. The longitudinal vertical component comprises a top side joined to a discontinuous bottom side by a first and second end wherein the discontinuous bottom side comprises a first portion and a second portion separated by a cavity. The longitudinal horizontal component comprises a distal end comprising a shoulder, wherein the shoulder extends through the cavity. Further disclosed herein is a load suspension device comprising two structural elements as disclosed above joined by an axle.

19 Claims, 6 Drawing Sheets

ROTARY SPREADER BEAM II

CLAIM FOR PRIORITY

Pursuant to 35 U.S.C. § 119(e), this Non-Provisional Application claims priority to Provisional Application Ser. No. 60/375,386 filed on Apr. 26, 2002.

BACKGROUND OF THE INVENTION

Disclosed herein is a suspension device. More particularly, disclosed herein is a load suspension device used to suspend and focus loads of any size and weight, such as audio or video devices used in theater or concert halls, houses of worship, or sport facilities.

Currently in the industry, there exists one dominant method for suspending and focusing audio and video devices as measured by elevation and azimuth angles. Most commercially available suspension systems are built specifically to suspend and focus one particular type of object, such as a particular video or audio device model. This results in an inventory of suspension kits and/or parts as numerous as the inventory of audio and video devices themselves.

Also, the dominant methodology does not incorporate into the load suspension systems any method for measuring angles. Rather, the dominant approach for audio devices is to have kits which allow for crude adjustment of elevation angle, but require a custom frame to be manufactured to set an azimuth, with different frames required for different discrete azimuth settings. The dominant approach for video devices, on the other hand, is a kit which allows for a minute level of elevation adjustment, with a method of analog control over azimuth.

Therefore, the currently available load suspension systems provide only two options by which to suspend a load:

1. Purchase a suspension system or kit which is built specifically to suspend and focus one particular model of video or audio device; or
2. Use standard suspension systems which will not allow for exact elevation and azimuth angle adjustment.

Neither of these options is practical, however, as maintaining an inventory of suspension kits to fit specifically with a particular model of video or audio device is expensive, cumbersome, and inefficient. Furthermore, the kits are not specifically adapted so as to measure angles; and therefore are not extremely adjustable and the load cannot be exactly focused.

Additional disadvantages of conventional suspension systems include the maximum weight that the system can support, as well as, difficulties in assembly. Therefore, further needed in the art of suspension systems is a device capable of supporting heavier loads, as well as, a device that can be facilely assembled.

BRIEF SUMMARY OF THE INVENTION

The above problems are alleviated by a structural element comprising a longitudinal vertical component and a longitudinal horizontal component extending from and parallel to the longitudinal vertical component. The longitudinal vertical component comprises a top side joined to a discontinuous bottom side by a first and second end wherein the discontinuous bottom side comprises a first portion and a second portion separated by a cavity. The longitudinal horizontal component comprises a distal end comprising a shoulder, wherein the shoulder extends through the cavity. Further disclosed herein is a load suspension device comprising two structural elements as disclosed above joined by an axle.

DETAILED DESCRIPTION OF THE PREFERRED EMBODIMENT

The invention will be described in relation to a preferred embodiment for use in handling audio and video devices, it being understood that the embodiment shown can be used to handle other objects. Thus, although specific forms, materials, and dimensions of the parts are referred to, these are not limiting features.

Figure 2:
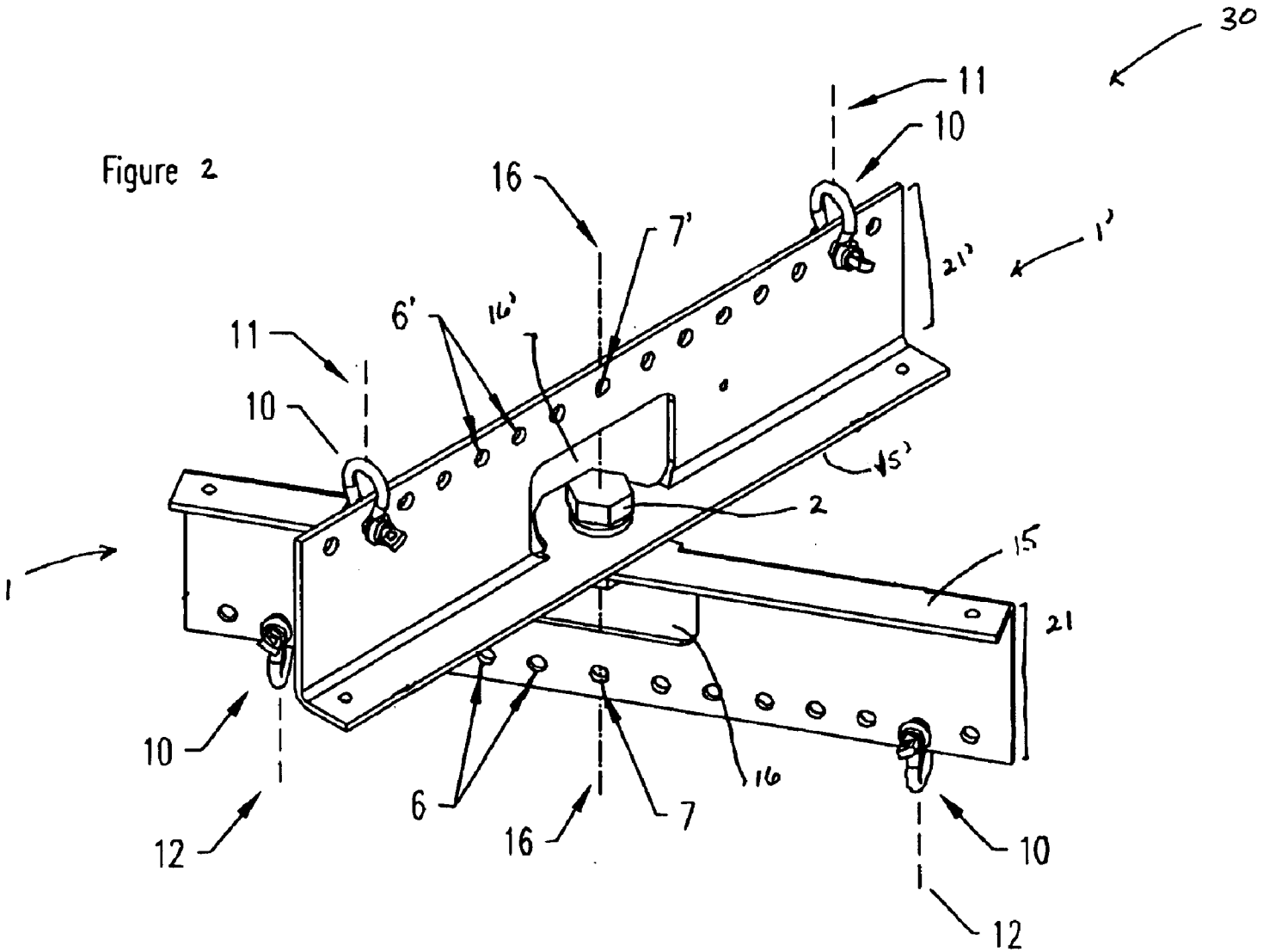
FIG. 2 is a schematic representation of an exemplary load suspension device.

Referring now to the figures, a load suspension device in the form of a formed sheet metal rotary spreader beam in accordance with the invention is depicted. As shown in FIG. 2, a rotary spreader beam 30 comprises a structural element 1' joined to a structural element 1 by means of an axle 2.

Figure 1:
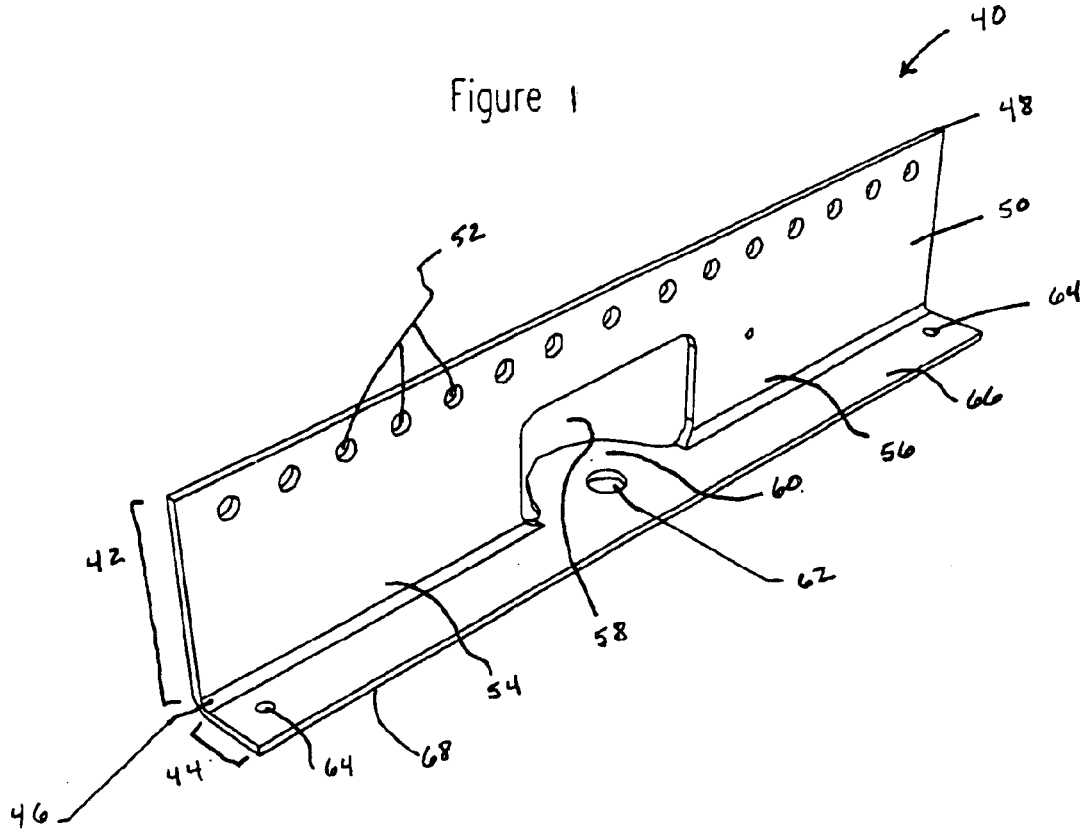
FIG. 1 is a schematic representation of an exemplary structural element.

An exemplary structural element is depicted in FIG. 1. Here, an exemplary structural element 40 comprises a longitudinal vertical component 42 attached to a longitudinal horizontal component 44 via a fold 46. It is noted that although in this embodiment, structural element 40 comprises fold 46 which allows for the continuous transition from longitudinal vertical component 42 to longitudinal horizontal component 44, it is contemplated that longitudinal vertical and horizontal components 42, 44 may be formed from distinct objects formed from the same or different materials, and may be joined together by any one of various common joining means, e.g., welding, screwing, nailing, etc.

Longitudinal vertical component 42 comprises a top side 48, a discontinuous bottom side, and a planar body 50. Planar body 50 comprises a plurality of apertures 52 disposed along a length of a top portion of planar body 50. Although the number of apertures forming plurality 52 may vary widely, and may include only a single aperture, it is preferred that at least one aperture be positioned along a center vertical axis of longitudinal vertical component 42, and that any additional apertures forming plurality 52 extend outward in an evenly distributed bidirectional fashion in reference to the centrally positioned aperture, and that the apertures extend along the entire length of planar body 50.

The discontinuous bottom side of longitudinal vertical component 42 includes a first portion 54 and a second portion 56 separated by a cavity 58, wherein cavity 58 extends upward through planar body 50 terminating at a level prior to contacting any one of the apertures forming plurality 52. Although the level to which cavity 58 can extend may vary widely, it is preferred that a sufficient amount of space be left between plurality of apertures 52 and cavity 58 such that a sufficient amount of support may be provided upon suspending the device and/or applying a load. Furthermore, the size of the cavity formed in the structural element should be sufficient to allow for ease in maneuver-ability by the operator as the operator assembles or adjusts the rotary spreader beam, particularly when the operator is manipulating the axle which is inserted through the structural element. That is, the cavity should be of sufficient size to provide a maximum amount of room necessary to manipulate the axle without diminishing the strength or function of the rotary spreader beam.

Longitudinal horizontal component 44 comprises a shoulder 60 which extends through cavity 58. Shoulder 60 comprises an axle hole 62, which comprises a hollowed-out portion of a top side 66 and a corresponding bottom side 68 of longitudinal horizontal component 44. Preferably, axle hole 62 is centrally positioned below cavity 58 along the center vertical axis of longitudinal vertical component 42.

Longitudinal horizontal component 44 further comprises at least one optional orifice 64, which may be used, for example to hold a locking bar as described in further detail below. Although FIG. 1 depicts two orifices 64, one at each peripheral end of longitudinal horizontal component 44, the number and position of the orifices may vary widely with the number and position dependent upon the weight of the load to be supported.

It is additionally noted that any of the surfaces forming the structural element disclosed herein, may have nameplates and adhesive labels bearing ASME B30.20 compliant declarations, instructions for use, safety warnings, and brand information.

Further, the longitudinal horizontal and vertical components may comprise a wide variety of the same or different geometrical shapes including, but not limited to, polygonal, circular, elliptical, discoidal, and the like. Preferably, however, both the longitudinal horizontal and vertical components comprise either a rectangular or a square geometrical shape.

Two structural elements as described above and as depicted in FIG. 1 may be utilized to form an exemplary rotary spreader beam. For example, referring to FIGS. 2–5, an exemplary rotary spreader beam 30 may be assembled by positioning a bottom side 15' of structural element 1' over a bottom side 15 of structural element 1 and aligning the two axle holes of structural elements 1, 1', wherein the axle holes are positioned along a center vertical axis 16. An axle 2 is inserted into and through the axle holes of structural elements 1, 1' and secured by friction bearings. Preferably axle 2 is a high strength steel alloy. The friction bearings serve to retain the relative angle $\alpha$ between the two structural elements 1 and 1'. The friction bearings may be tightened sufficiently to prevent free turning of the structural elements on the axle, but loose enough so that the relative angle $\alpha$ may be adjusted either by machinery or by hand.

Figure 3:
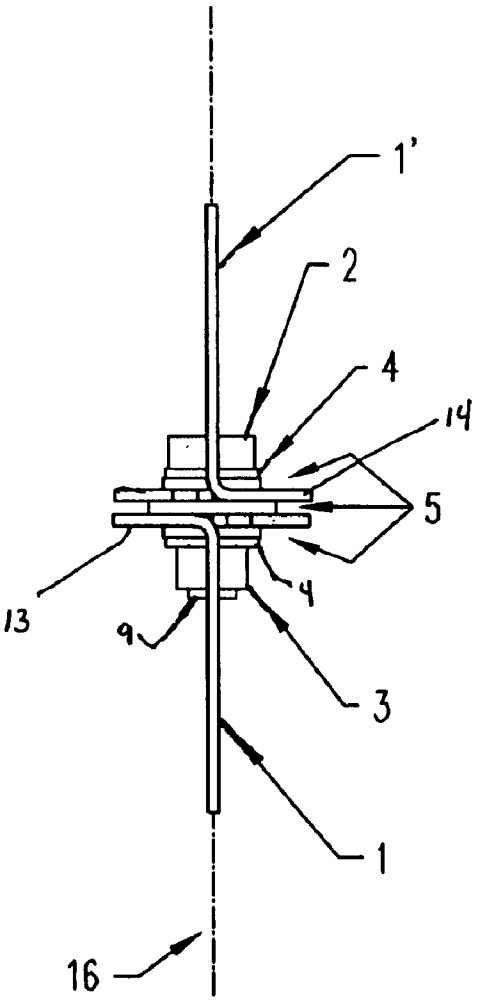
FIG. 3 is a schematic representation of an end view of the exemplary load suspension device of FIG. 2.
Figure 4:
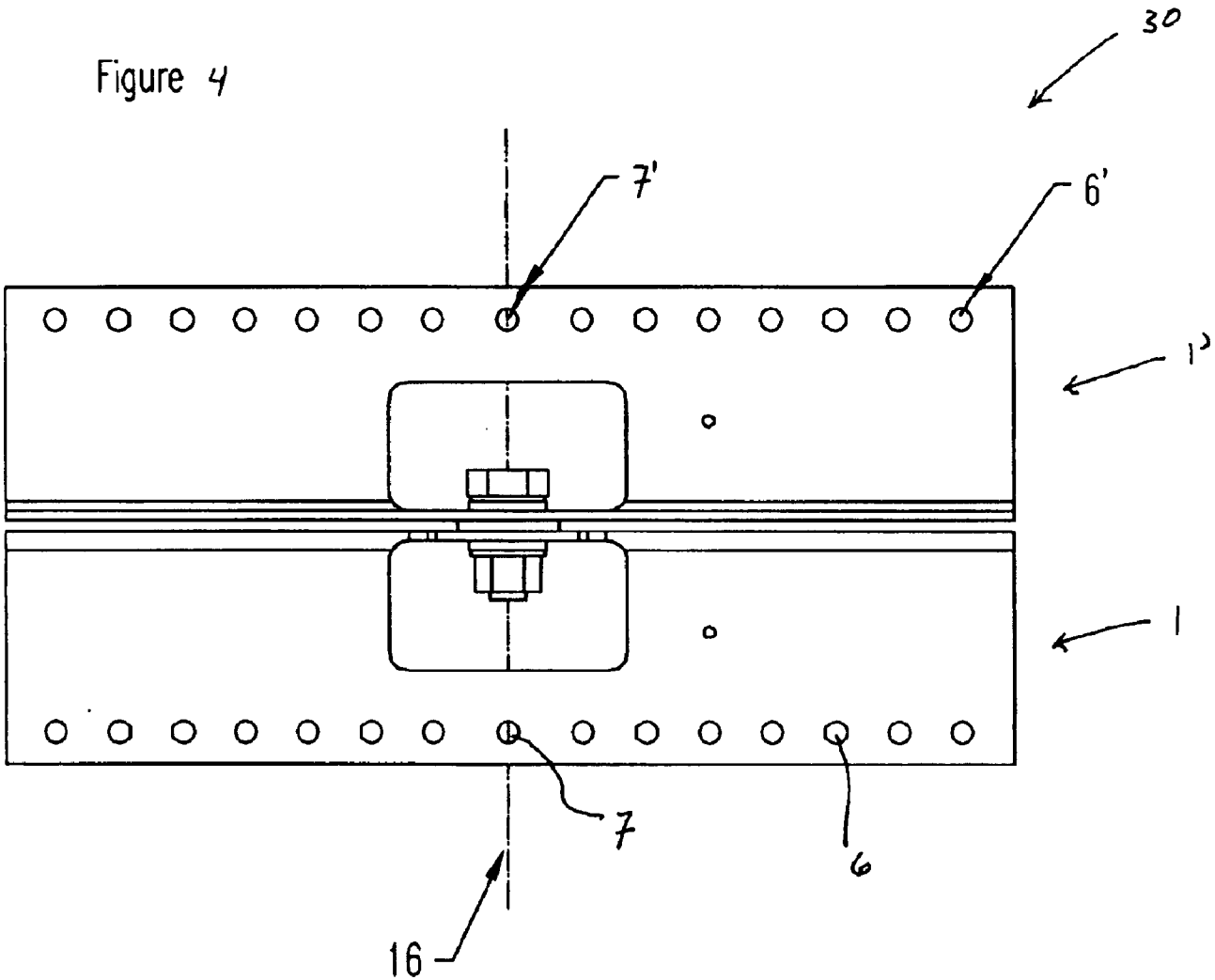
FIG. 4 is a schematic representation of a front view of the exemplary load suspension device of FIG. 2.

An exemplary positioning of axle 2 and the friction bearings through the axle holes of structural elements 1, 1' is best shown in FIG. 3. Here, at the center vertical axis 16, axle 2 joins structural element 1 and structural element 1'. Axle 2 is fabricated of a high strength steel and passes into and through the axle holes of structural elements 1, 1'. Axle 2 is preferably a high strength alloy steel bolt with a hexagonal head, extending into the axle hole of structural element 1, with the threaded end 9 extending into the axle hole of structural element 1'. A high strength locking nut 3 at the end of axle 2 on the side of structural element 1 holds axle 2 in place. On axle 2, again on the side of structural element 1, a hardened washer 4 and a bushing 5 are disposed between nut 3 and a longitudinal horizontal component 13 of structural element 1. Furthermore, a hardened washer 4 and a bushing 5 are disposed between axle 2 and a longitudinal horizontal component 14 of structural element 1'. Although not shown, a nut may also be disposed on a side of washer 4 opposite to bushing 5 on the portion of the axle disposed on the side of structural element 1'. Furthermore, to maintain a small space between structural elements 1, 1', a bushing 5 is situated on axle 2 between longitudinal horizontal components 13, 14.

Figure 5:
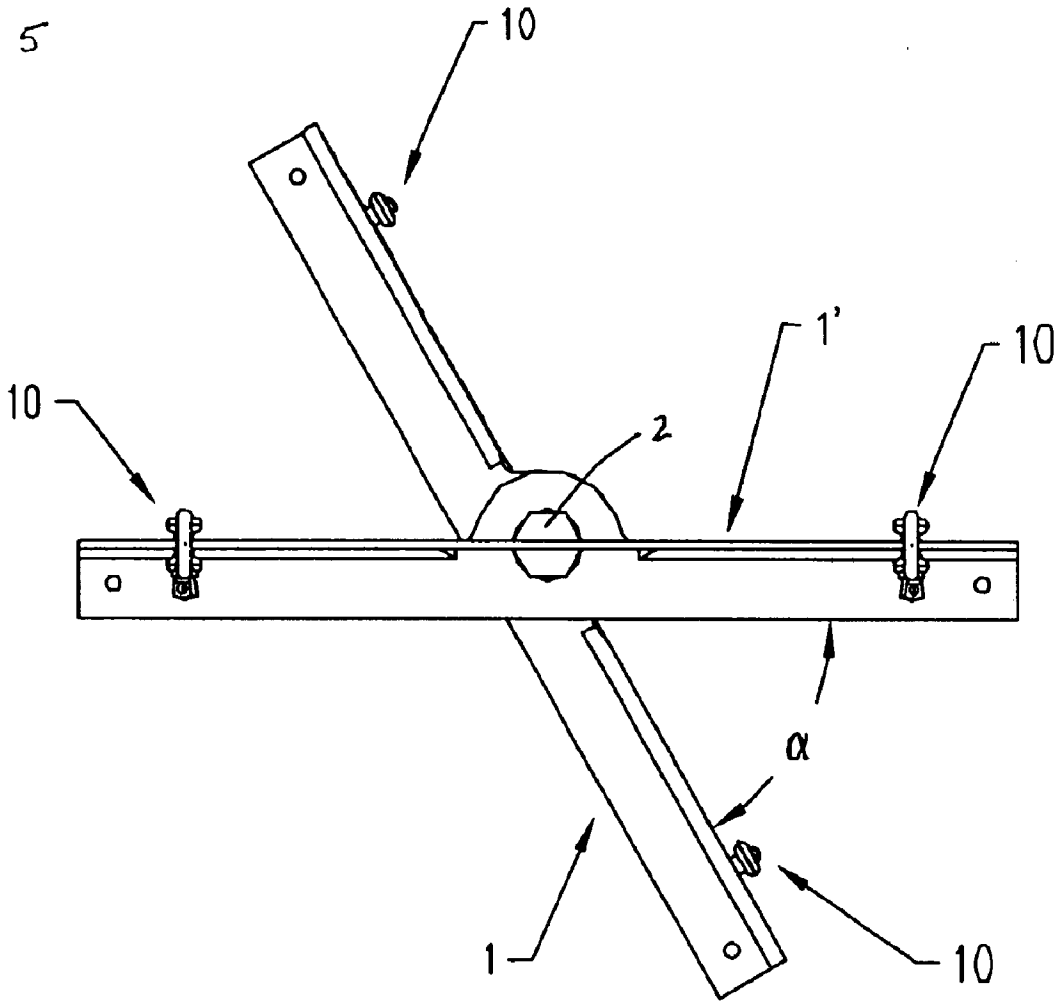
FIG. 5 is a schematic representation of a top view of the exemplary load suspension device of FIG. 2.

Nut 3 is tightened so as to prevent free rotation of structural elements 1, 1' with respect to each other, but also to allow structural element 1 and structural element 1' to rotate in a plane with respect to each other using either a machine or moderate hand pressure such that the positional relationship of first structural element 1 to structural element 1' forms a relative angle $\alpha$ That is, as shown in FIG. 5, axle 2 allows structural elements 1, 1' to rotate either clockwise or counterclockwise in respect to each other, thereby producing an adjustable relative angle $\alpha$ between the elements.

The relative angle $\alpha$ between the two structural elements forming the rotary spreader beam may be measured with a conventional protractor used in the construction industry or an inexpensive printed protractor card supplied as an accessory to the rotary spreader beam.

Referring to FIGS. 2 and 5, rotary spreader beam 30 may be suspended with a number of industry standard anchor or chain shackles 10 that pass through any one or more of the apertures 6' in longitudinal vertical component 21' of structural element 1'. Device suspension means, for example: wire rope assemblies, chains, or fiber straps, as generally depicted by reference numeral 11, may then be connected to shackles 10 to suspend rotary spreader beam 30 from a desired location. Rotary spreader beam 30 may be suspended, for example, using one shackle 10 and suspension means 11 at an aperture 7' located in the center of longitudinal vertical component 21', or by using up to a maximum number of shackles and suspension means as there are apertures.

Additionally, a load may be supported from structural element 1 with a number of industry standard anchor or chain shackles 10 that pass through any one or more of the apertures 6 in longitudinal vertical component 21. Load supporting means, for example: wire rope assembles, chains, or fiber straps, shown generally by reference numeral 12, may then be connected to shackles 10 to support the load from rotary spreader beam 30. The load may be supported using one shackle 10 and load supporting means 12 at an aperture 7 located in the center of longitudinal vertical component 21, or by using up to a maximum number of shackles and load supporting means as there are apertures. Because the load supporting means are adaptable to various types of loads, an inventory of parts each adjustable to a particular type of load is not required.

Figure 6:
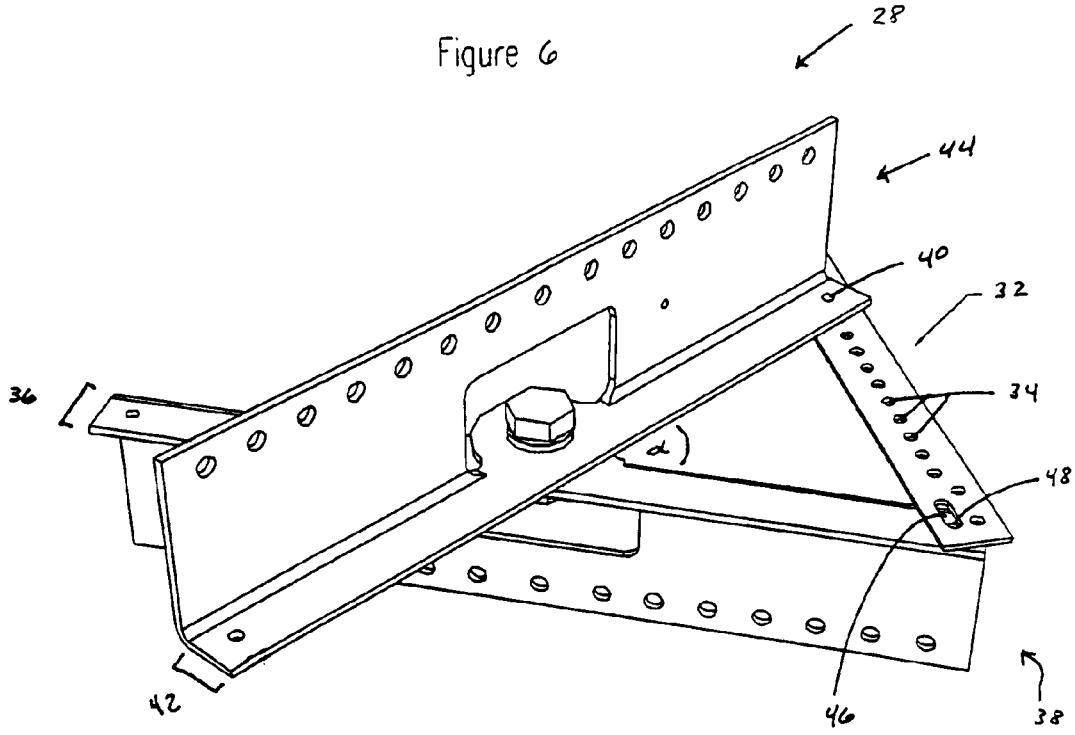
FIG. 6 is a schematic representation of an exemplary embodiment of a load suspension device comprising a locking bar.

FIG. 6 depicts an exemplary embodiment of a rotary spreader beam 28 comprising a locking bar 32. As shown in FIG. 6, locking bar 32 comprises a series of apertures 34. A single aperture (not shown) from series 34 may be aligned with an orifice 40 located on a longitudinal horizontal component 42 of a structural element 44; and another aperture 46 may be aligned with an orifice 48 located on a longitudinal horizontal component 36 of a structural element 38. Locking bar 32 may be used to secure the desired angle $\alpha$ and prevent unintentional rotation of structural element 28 in respect to structural element 44. Locking bar 32 may comprise any material capable of sustaining the load, and preferably comprises metals, such as, iron and steel. Further, locking bar 32 may be secured onto the load suspension device with standard threaded fasteners (not shown). Finally, although only one locking bar is depicted in FIG. 6, it is contemplated that additional locking bars may be simultaneously positioned to connect the two longitudinal horizontal components of the structural elements, the number being dictated by the weight of the load.

The load suspension device disclosed herein provides several advantages over those load suspension devices currently known. For example, the disclosed load suspension device provides analog control over azimuth with the built-in ability to read and set the azimuth of the particular instance of the suspended equipment. Accordingly, the disclosed device is ideally suited for use where a load must be suspended and where the angle and elevation are both necessary elements for the correct suspension of the load. This single device will also work with a very broad range of audio and video devices, thereby greatly reducing the required inventory of suspension kits.

Furthermore, the disclosed device is easy to adjust, it is lightweight, and it is inexpensive to manufacture. Due to the introduction of a cavity centered over the axle hole, the load suspension-device is easier to assemble, as the cavity provides sufficient room in which to maneuver the axle into position. As the device is easier to assemble, the machinery used to assemble conventional devices is not required, thereby significantly reducing the costs of assembly. Also, with the addition of the locking bar in the manner disclosed above, the device is able to retain the relative angle $\alpha$ even in environments where the suspension device may receive direct impacts from sporting equipment such as basketballs or footballs.

The disclosed load suspension device is additionally advantageous in that it utilizes industry-standard forge shackles for attachment points instead of more expensive custom fittings. The device also is able to utilize conventional high strength alloy steel bolts with a hexagonal head for the axle, instead of more expensive custom manufactured axles. The device can also incorporate a plurality of attachment points to both the top and bottom portions of the device thereby providing various possibilities for adjustment. Finally, the disclosed load suspension device presents a device which requires no tools or mechanisms to adjust relative angles.

Having described the preferred embodiment of the invention with reference to the accompanying drawings, it is to be understood that the invention is not limited to these precise embodiments in that various changes and modifications may be effected therein by one skilled in the art without departing from the scope or spirit of the invention.

What is claimed is:

1. A structural element comprising:

longitudinal vertical component comprising:

a top side joined to a discontinuous bottom side by a first and second end wherein the discontinuous bottom side comprises a first portion and a second portion separated by a cavity; and an upper portion and a lower portion, wherein the upper portion is towards the top side and comprises a plurality of apertures, and wherein the cavity extends through a fraction of the lower portion; and a longitudinal horizontal component extending from and parallel to the first and second portions, wherein the lower portion of the longitudinal vertical component is towards the longitudinal horizontal component, and wherein the longitudinal horizontal component comprises:

a distal end comprises a shoulder, wherein the shoulder extends through the cavity.

2. The structural element of claim 1, wherein one of the apertures forming the plurality of apertures is centrally positioned along a center vertical axis of the longitudinal vertical component.

3. The structural element of claim 2, wherein additional apertures forming the plurality of apertures are positioned in an evenly distributed bidirectional fashion in relation to the aperture centered along the center vertical axis.

4. A load suspension device comprising:

a first and second structural element wherein each of the first and second structural element comprises:

a longitudinal vertical component comprising:

a longitudinal vertical body disposed between a top side and a discontinuous bottom side, wherein the longitudinal vertical body comprises an upper portion directed towards the top side and a lower portion directed towards the discontinuous bottom side; and wherein the discontinuous bottom side comprises a first portion and a second portion separated by a cavity, wherein the cavity extends through a faction of the lower portion of the longitudinal vertical body; and a longitudinal horizontal component extending from and parallel to the first and second portions, comprising:

a distal end comprising a shoulder, wherein the shoulder extends through the cavity, and further wherein the shoulder comprises a top surface, a bottom surface, and an axle hole;

wherein the bottom surface of the shoulder of the first structural element is disposed over the bottom surface of the shoulder of the second structural element such that the axle holes of the first and second structural elements are aligned.

5. The load suspension device of claim 4, wherein the first and second structural element comprises steel.

6. The load suspension device of claim 4, wherein at least one of longitudinal horizontal components extends from and is parallel to the corresponding first and second portions by means of a fold.

7. The load suspension device of claim 4, wherein the upper portion of at least one of the first and second structural elements comprises a plurality of apertures evenly distributed along a length of the upper portion.

8. The load suspension device of claim 7, wherein one of the apertures forming the plurality of apertures is centrally positioned along a center vertical axis of the corresponding longitudinal vertical component.

9. The load suspension device of claim 8, wherein additional apertures forming the plurality of apertures are positioned in an evenly distributed bidirectional fashion in relation to the aperture centered along the center vertical axis.

10. The load suspension device of claim 7, further comprising:

shackles removably mounted on at least one of the plurality of apertures; and a load supporting means removably mounted on each of the shackles.

11. The load suspension device of claim 10, wherein the load supporting means is a wire rope assembly.

12. The load suspension device of claim 10, wherein the load supporting means is a chain assembly.

13. The load suspension device of claim 10, wherein the load supporting means is a fiber strap assembly.

14. The load suspension device of claim 4, wherein the cavity of at least one of the first and second structural elements is centrally positioned along a center vertical axis of the corresponding first and second longitudinal vertical component.

15. The load suspension device of claim 4, wherein at least one of the longitudinal horizontal components of the first and second structural elements further comprises at least one orifice.

16. The load suspension device of claim 4, wherein:

each of the first and second structural elements comprises at least one orifice positioned through a peripheral portion of the longitudinal horizontal component; and a locking bar comprising a plurality of apertures;

wherein one aperture of the plurality of apertures of the locking bar is aligned with one of the orifices of the first structural element, and another aperture of the plurality of apertures of the locking bar is aligned with another one of the orifices of the second structural element.

17. The load suspension device of claim 4, further comprising an axle disposed through the cavities of the first and second structural elements.

18. The load suspension device of claim 17, wherein the axle allows the first structural element and the second structural element to rotate in a plane around the axle with respect to each other such that the positional relationship of the first structural element to the second structural element forms a relative angle $\alpha$.

19. The load suspension device of claim 17, wherein the axle comprises a steel alloy.

* * * * *